United States Patent [19]

Degelman

[11] 4,220,210

[45] Sep. 2, 1980

[54] TRACTOR FRONT SUPPORTED IMPLEMENT ATTACHMENT FRAME

[75] Inventor: Wilfred J. Degelman, Regina, Canada

[73] Assignee: Degelman Industries Ltd., Regina, Canada

[21] Appl. No.: 846,978

[22] Filed: Oct. 31, 1977

[51] Int. Cl.[2] ..... E02F 3/76

[52] U.S. Cl. ..... 172/276; 280/762

[58] Field of Search ..... 280/760, 762; 214/135 A; 105/224; 172/276, 809, 801, 306, 806

[56] References Cited

U.S. PATENT DOCUMENTS

| | | | |
|---|---|---|---|
| 2,955,844 | 10/1960 | Wills | 280/760 |
| 3,521,714 | 7/1970 | Farris | 172/806 X |
| 3,653,451 | 4/1972 | Fryrear et al. | 172/806 X |
| 3,762,481 | 10/1973 | Allen et al. | 172/801 X |
| 3;815,687 | 6/1974 | Federspiel | 172/801 |
| 3,866,773 | 2/1975 | Koch | 280/762 X |
| 4,018,771 | 2/1977 | Tornio | 172/806 |
| 4,031,968 | 6/1977 | Krolak | 172/801 |

*Primary Examiner*—John J. Love
*Assistant Examiner*—Norman L. Stack
*Attorney, Agent, or Firm*—Christensen, O'Connor, Johnson & Kindness

[57] ABSTRACT

A tractor front end frame assembly readily detachable from the tractor body for supporting implements such as a front-end bulldozer blade and supported from the tractor by a front central removable attachment capable of pivotal motion about a substantially horizontal axis perpendicular to the rear axle of the tractor and on each side of the rear axle with optional support of the frame provided at about the midway point on the sides of the tractor. The presence of only a pivotal connection at or near the front of the tractor reduces the possibility of damage producing torque to the vehicle in that area.

7 Claims, 4 Drawing Figures

TRACTOR FRONT SUPPORTED IMPLEMENT ATTACHMENT FRAME

BACKGROUND OF THE INVENTION

The present invention relates to a tractor implement attachment device comprised of a frame assembly used to support a variety of front-end implements.

Conventional front-end tractor frame assemblies have been fixedly attached to and are not readily detachable therefrom the tractor body at the front portion of the tractor and have tended, when in use with a front-end implement, to exert strong torque on the front-end of the tractor frequently causing damage thereto.

SUMMARY OF THE INVENTION

It is an object of the present invention to overcome the aforementioned problems by supporting the frame assembly with removable pin connections or the like on either side of the tractor at the rear (and optionally at about the midway points along the sides of the tractor) and by a single central forward slideable pin connection at the front of the tractor.

The present invention is a supporting frame for an implement such as a front-end bulldozer blade for removable attachment to a vehicle such as a tractor. The vehicle is provided with a rear axle frame housing a rear axle and a pivotal support mounting at the front end of the vehicle. The supporting frame comprises, in combination, a longitudinal frame, rear axle hanging means for the longitudinal frame, and front pivotal connection means attached to the longitudinal frame. The longitudinal frame extends more or less from the front of the vehicle to the rear axle, lying generally on the underside of the vehicle (or having frame elements at the sides of the vehicle). The rear axle hanging means is connected to opposed sides of the longitudinal frame, for removably hanging the latter on the rear axle frame of the vehicle. The front pivotal connection means is connected to the forward portion of the longitudinal frame for detachable pivotal mounting thereof on the pivotal support mounting. The pivotal connection means may conveniently take the form of a pin and mating receptacle, one on the vehicle and the other on the longitudinal frame (or element attached to the latter).

The supporting frame is thus firmly and rigidly attachable to the strong part of a tractor, viz. the rear axle frame, whilst the weaker front part of the tractor needs only to support the weight of the forward part of the supporting frame and attached implement. No torsional stresses are transmitted to the tractor nose, since the supporting frame is capable of pivotal motion about a substantially horizontal axis substantially perpendicular to the rear axle of the vehicle. In most applications, the supporting frame when mounted on the vehicle would be generally symmetrical about the longitudinal axis of the vehicle.

In one embodiment, the frame assembly is made up of front and rear side sub-frames and rear axle connection assembly with the front side sub-frame adapted to receive at its front end a pivotal implement mounting. The front side sub-frame is comprised of a pair of generally parallel side beam elements each element at its front end having an arm projecting upward at an angle with the horizontal suitable for convenient orientation relative to the tractor and particularly to the pivotal support mounting. A transverse beam connected to the two arms near their upper end has a centrally located pin receptacle for slideably engaging a pivot pin projecting from the front centre portion of the vehicle and having an axis which is parallel to the longitudinal axis of the tractor and substantially horizontal. Obviously, the same connection mechanism could be achieved by having the pivot pin projecting from the centre of the transverse beam element and the pin receptacle located in the front centre of the tractor. The front side sub-frame is adapted to receive at its front end a pivot frame member comprised of a beam element pivotally connected to the front of each side beam element of the front side sub-frame and pivotally supported from the upper end of each of the upward projecting arms of the front side sub-frame by an interconnecting hydraulically-operated piston cylinder unit. The usual implement which the frame assembly is intended to support is a bulldozer blade. The free ends of the two pivot frame members could also support an attached front-end implement such as a front-end loader, plough, snowblower, fork-lift, hay fork, or other similar device. The rear side sub-frame assembly consists of two parallel side beam elements joined at the backward end by a rigidly attached transverse beam element of a length longer than the spacing of the two side beam elements and having at each end equal length portions extending beyond the point of attachment to the side beam elements. On each extension of the transverse beam element is a mounting bracket arrangement used to fasten the rear side sub-frame to the rear axle of the vehicle. Each mounting bracket arrangement is movable along the transverse beam element extensions so as to accommodate vehicles having different widths and is comprised of an upper and lower set of mounting brackets vertically arranged so that the upper one clamps to one side of the rear axle of the vehicle and has a vertically projecting plate which mates with and is received by a vertically projecting clevis projecting up from the lower bracket. Both the projecting plate from the upper bracket and the projecting clevis from the lower bracket have transverse pin receptacles and are fastened together by means of a transverse removable pin mating with and received by the said pin receptacles. The lower bracket is attached to one of the transverse beam element extensions. Obviously an equivalent arrangement would have the clevis projecting down from the upper bracket and the plate projecting up from the lower bracket. The parallel side beam elements of the rear side sub-frame have a number of bolt holes drilled to mate with corresponding bolt holes drilled in the rear of the side beam elements of the front side sub-frame. The overall length of the frame assembly may be adjusted to fit vehicles of different lengths. The frame assembly receives some additional vertical support and intermediate tractor frame stability from two interconnecting arms of adjustable length which are pinned at one end to the frame assembly and at the other end to a bracket on the side of the tractor body approximately midway along the tractor.

DETAILED DESCRIPTION OF PREFERRED EMBODIMENT

Figure 1:
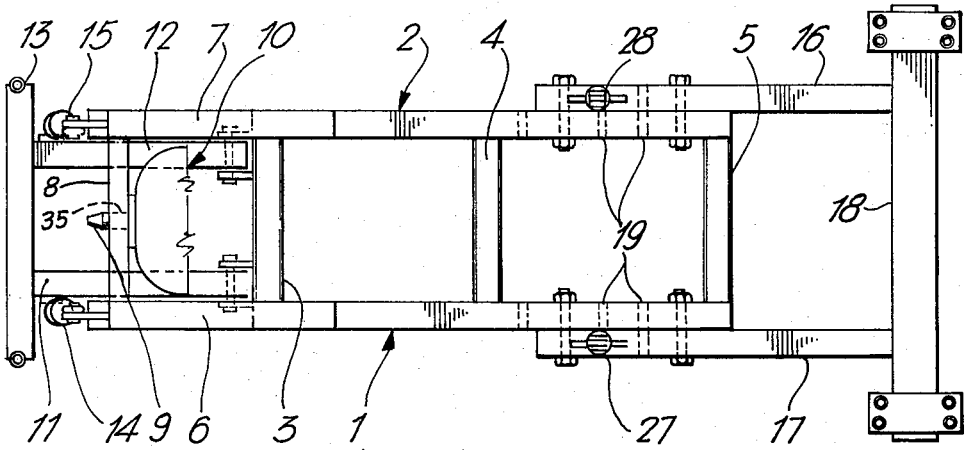
FIG. 1 is a plan view of the frame assembly.

In FIG. 1 the side sub-frame assembly is comprised of two parallel substantially horizontal side beam elements 1 and 2 joined by transverse beam elements 3, 4, and 5. At the front of the side beam elements 1,2 are rigidly fastened two upward projecting parallel members 6 and 7 at an angle with the horizontal suitable for convenient orientation relative to the tractor and to a pivotal support mounting. The upward projecting members 6 and 7 are joined at their upper end by a rigidly attached transverse beam element 8 having a centrally located pin receptacle 35 designed to slideably receive a pivot pin 9 rigidly fastened to the tractor front end 10 and whose axis is substantially horizontal and substantially parallel to the longitudinal axis of the vehicle. Alternatively, equivalent front pivotal connection means includes a pin receptacle centrally located on the tractor front end 9, and a mating pivot pin centrally located on the transverse beam element 8. Obviously, any other type of pivotal connection allowing for pivotal motion about the longitudinal axis of the tractor and without substantial lateral or vertical movement would be within the scope of this invention. The front of the front side sub-frame assembly is adapted to receive a pivot frame unit comprising two parallel side beam elements 11 and 12 each pivotally connected to the front of one of the two side beam elements of the front side sub-frame and each supported at its free end from the upper end of one of the two upward projecting arms of the front side sub-frame by means of an interconnecting hydraulically-operated piston cylinder unit 14 and 15. The two parallel side beam elements 11 and 12 of the pivot frame are welded at their free end to one another by a cross piece 13 which has bushings on each end to allow it to be pinned to an implement such as a bulldozer blade. The pivot frame would of course be designed to accommodate the particular front-end implement for which the frame is intended. At the rear of the front side sub-frame at intervals along the two horizontal side beam elements in a horizontal axis and perpendicular to the longitudinal axis of the frame are a series of bolt holes 19. When the two horizontal side beam elements of the rear side sub-frame 16 and 17 are positioned parallel and in the same horizontal plane as the corresponding horizontal beam elements of the front side sub-frame, four or more bolt holes in the front side sub-frame mate with corresponding holes in the rear side sub-frame in any of several relative positions so as to make the frame assembly of adjustable length.

Figure 2:
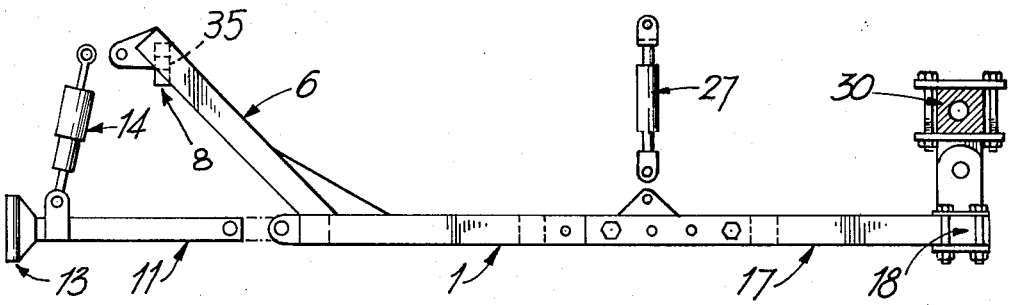
FIG. 2 is an elevation view of the frame assembly showing a pivot frame attachment.

As seen in both FIGS. 1 and 2, the frame assembly is connected to the tractor body in the region of overlap of the side beam elements of the front side sub-frame with those of the rear side sub-frame by two interconnecting arms 27 and 28 of adjustable length pinned at the lower end to the frame assembly and at the upper end to the tractor side support mounting bracket 31 by means of quick release pins. The interconnecting arms, 27 and 28, however, may be attached to the frame assembly outside the region of overlap of the side beam elements in some cases depending on the size of the tractor to which it is adapted to fit, or dispensed with completely. The rear ends of the two horizontal side beam elements of the rear frame are joined to a transverse beam element 18 having ends which extend beyond the parallel side beam elements with the two extensions being of equal length. Attached onto each of these extensions in an adjustable transverse position is an upper mounting bracket 20 which is attached to a lower mounting bracket 21 mounted on each side of the rear axle of the tractor or other vehicle.

Figure 3:
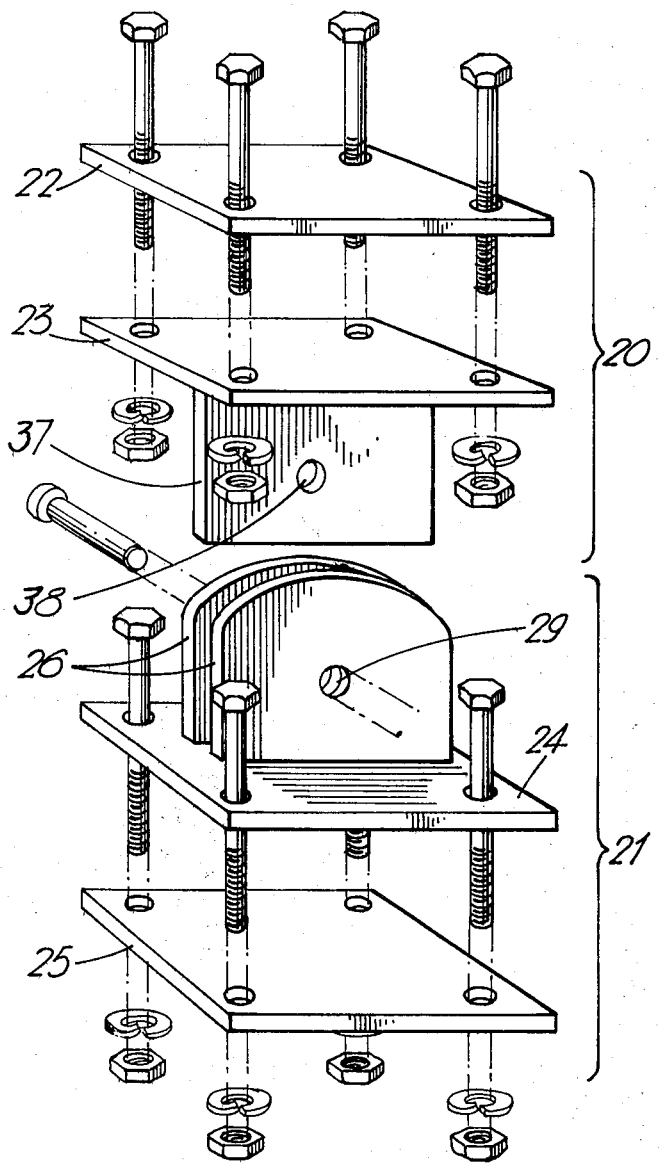
FIG. 3 is an exploded perspective view of the mounting bracket arrangement for the rear axle.

In FIG. 3 the mounting bracket 20 comprised of two flat rectangular plates 22 and 23 the top plate 22 having a bolt hole at each of its four corners which mates with a corresponding bolt hole on the bottom plate 23 and the bottom plate having an integral downward plate 37 with a centrally located pin receptacle 38 is mounted on each end of the tractor rear axle 30 such that the axis of the pin receptacle is substantially horizontal and parallel to the rear axle of the tractor. A corresponding lower mounting bracket 21 also comprised of two flat rectangular plates 24 and 25 between which is clamped each extension of the transverse beam element 18 and having a similar arrangement of bolt holes as the upper mounting bracket has an upward projecting clevis 26 integral with the upper plate 24, said clevis having a centrally located pin receptacle 29 such that when the downward projecting plate 37 of the upper bracket mates with the clevis 26 of the lower bracket, the pin receptacle of the former plate 38 mates with that of the clevis 26. The mating pin receptacles so aligned mate with and receive a quick release pin which fastens the upper mounting bracket to the lower mounting bracket.

Figure 4:
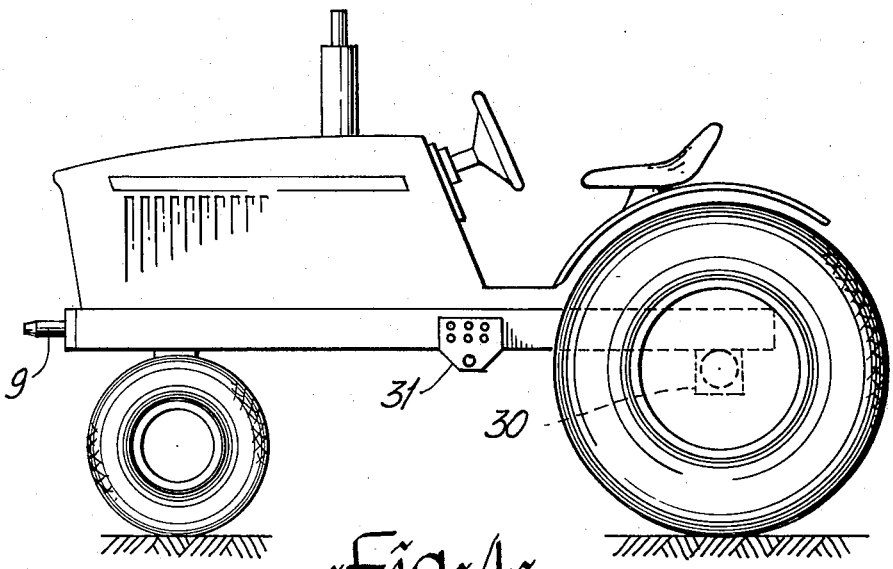
FIG. 4 is a side elevation view of a tractor having a rear axle frame, a pivotal support mounting and a side support mounting.

A tractor adapted to receive the frame assembly herein, shown by way of illustration in FIG. 4, has a side support mounting 31 fixed to the tractor frame on one side of the tractor, positioned to receive one end of the connecting arm 27 and an identical mounting on the other side to receive one end of connecting arm 28.

In operation, when a front-end implement such as a bulldozer blade is attached to the pivot frame cross piece 13 and subjected to a force through operation, the pivot pin 9 prevents sideways movement of the front of the frame with respect to the tractor and also assists in preventing downward deflection of the side sub-frame. The interconnecting arms of adjustable length 27 and 28 provide substantially vertical support for the midway portion of the frame. Both vertical and horizontal support are provided by the two rear axle mounting arrangements. The absence of fixed connections at or near the front of the tractor prevents it from being subjected to damage-producing excessive torque.

What is claimed is:

1. For detachable mounting on a vehicle such as a tractor having a rear axle frame housing a rear axle, and a pivotal support mounting at the front end of the vehicle, a supporting frame for an implement such as a front-end plow comprising, in combination:

longitudinal frame means extending when mounted between the front end and rear axle of the vehicle;

transversely spaced rear axle hanging means connected to opposed sides of the longitudinal frame means in the vicinity of the rear portion thereof for removably hanging the longitudinal frame means from the rear axle frame; and front pivotal connection means connected to the forward portion of the longitudinal frame means for detachable pivotal mounting thereof on the front end of vehicle, said front pivotal connection means being detachably pivotally mountable on said pivotal support mounting, the axis of said pivotal support mounting being generally horizontal and perpendicular to the rear axle of the vehicle.

2. A frame as defined in claim 1, wherein said front pivotal connection means, when mounted, is pivotally attached to said pivotal support mounting by means of a pin which removably engages a mating pin receptacle.

3. A frame as defined in claim 2, for use with said vehicle, having said pin projecting forwardly from said pivotal support mounting, wherein said receptacle is located on and centrally of said front pivotal connection means.

4. A frame as defined in claim 3, wherein the receptacle is a hole in the front pivotal connection means.

5. A frame as defined in claim 2 for use with said vehicle having on each side thereof a side support mounting attached thereto additionally comprising an adjustable interconnecting arm removably connectable between the side of the longitudinal frame means and the corresponding side support mounting.

6. A frame as defined in claim 2, wherein each of the rear axle hanging means comprises a mounting bracket fixed to the rear axle frame and having a transverse pin receptacle, a mounting bracket fixed to the rear of said longitudinal frame means and having a transverse pin receptacle, and a transverse removable pin mating with and receivable by said pin receptacles.

7. A supporting frame as defined in claim 2, wherein the longitudinal frame means, when mounted, extends underneath the vehicle.

* * * * *